US008759751B2

(12) United States Patent
Makarov et al.

(10) Patent No.: US 8,759,751 B2
(45) Date of Patent: Jun. 24, 2014

(54) MASS SPECTROMETRY DETECTOR SYSTEM AND METHOD OF DETECTION

(75) Inventors: Alexander Makarov, Bremen (DE); Anastassios Giannakopulos, Bremen (DE)

(73) Assignee: Thermo Fisher Scientific (Brmen) GmbH, Bremen, DE (US)

( * ) Notice: Subject to any disclaimer, the term of this patent is extended or adjusted under 35 U.S.C. 154(b) by 0 days.

(21) Appl. No.: 13/698,413

(22) PCT Filed: May 24, 2011

(86) PCT No.: PCT/EP2011/058415

§ 371 (c)(1),
(2), (4) Date: Nov. 16, 2012

(87) PCT Pub. No.: WO2011/147804

PCT Pub. Date: Dec. 1, 2011

(65) Prior Publication Data

US 2013/0062518 A1 Mar. 14, 2013

(30) Foreign Application Priority Data

May 27, 2010 (GB) ..... 1008876.3

(51) Int. Cl.
*H01J 49/48* (2006.01)
*H01J 49/26* (2006.01)
*H01J 49/40* (2006.01)

(52) U.S. Cl.
USPC ..... 250/281; 250/282; 250/294; 250/295; 250/296; 250/297

(58) Field of Classification Search
USPC ..... 250/287, 297, 394
See application file for complete search history.

(56) References Cited

U.S. PATENT DOCUMENTS

| | | | | |
|---|---|---|---|---|
| 3,413,468 | A * | 11/1968 | Astheimer | 250/338.1 |
| 5,572,022 | A * | 11/1996 | Schwartz et al. | 250/282 |
| 5,886,346 | A * | 3/1999 | Makarov | 250/291 |
| 2006/0214100 | A1 | 9/2006 | Verentchikov et al. | |
| 2008/0315080 | A1 * | 12/2008 | Makarov et al. | 250/281 |
| 2009/0189064 | A1 * | 7/2009 | Miller et al. | 250/282 |
| 2009/0294643 | A1 | 12/2009 | Steiner | |

FOREIGN PATENT DOCUMENTS

WO WO 2010/136533 A1 12/2010

* cited by examiner

*Primary Examiner* — Jack Berman
*Assistant Examiner* — Kevin Chung
(74) *Attorney, Agent, or Firm* — Charles B. Katz

(57) ABSTRACT

Methods and analyzers useful for time of flight mass spectrometry are provided. A method of determining properties of ions within a time of flight or electrostatic trap mass analyzer comprises the steps of: injecting ions into the mass analyzer; causing the ions to follow a portion of a main flight path within the mass analyzer, the main flight path comprising multiple changes of direction; applying a beam deflection to deflect at least some of the ions from the main flight path so that they impinge upon a detection surface located within the mass analyzer, the detection surface comprising part of an active field-sustaining electrode of the mass analyzer; measuring a quantity representative of the charge arriving at the detection surface caused by the impinging ions; determining, from the deflection applied, properties of a trajectory upon which the ions were travelling immediately prior to deflection, and/or determining, from the quantity measured, a value representative of the number of the ions that impinged upon the detector surface; and wherein the analyzer utilises an analyzer field, the detection surface sustains the analyzer field in its vicinity, and the analyzer field in the vicinity of the detection surface is substantially non-zero.

22 Claims, 5 Drawing Sheets

MASS SPECTROMETRY DETECTOR SYSTEM AND METHOD OF DETECTION

FIELD OF THE INVENTION

The invention relates to the field of mass spectrometry; specifically it relates to detection of ions within the mass analyzer of a mass spectrometer.

BACKGROUND

Ion beams are transported through a mass analyzer during the process of mass separation within the analyzer. Time of flight (TOF) mass analyzers and electrostatic trap (EST) mass analyzers may direct the ions upon lengthy and/or complex beam trajectories, especially where high mass resolution is to be obtained by the analyzer. For example, high resolution multi-reflection TOF (MR-TOF) mass analyzers may have beam path lengths of several meters, or several tens of meters and recent designs do not utilise long, straight field-free regions, but instead ions follow complex curved or folded ion trajectories, in some cases whilst continuously in the presence of an analyzer field. Examples of such analyzers include multi-sector MR-TOF designs such as are described in U.S. Pat. No. 7,399,960, multi reflection mirror TOF designs as described in WO 2005/001878 and helical path TOF designs such as are described in U.S. Pat. No. 7,186,972. A long and/or complex beam path within such an analyzer can be difficult to maintain precisely. Variation, upon entry to the analyzer, in ion beam characteristics such as spatial position, trajectory and beam energy for example, can cause the ion beam to fail to complete the desired ion beam path within the analyzer, possibly causing it, or part of it, to be lost by collision with some elements of the analyzer structure on route. With a complex beam path and a complex analyzer structure, failure to detect an emerging ion beam may render the analyzer unusable, as determining the cause of the problem can be too difficult to resolve. Alternatively, the ion beam may successfully traverse the analyzer, but may not follow the optimum beam path, travelling in regions where the analyzer fields are not as precisely maintained, thereby suffering beam aberrations. Interfacing preceding ion optical devices to such mass analyzers and tuning mass analyzers for routine operation may therefore be problematical.

Some designs of TOF and EST mass analyzers utilise electric fields, in some cases strong electrostatic fields, which are present along most or all the ion beam path within the analyzer, and for high mass resolution to be achieved by the analyzer, these electrostatic fields have to be precisely generated and maintained throughout the time the ion beam is within the analyzer. Where strong fields are present, yet higher precision is required of the injected beam characteristics as slight misalignments of the ion beam path are exaggerated by the strong field and the beam rapidly diverges from the ideal beam path. This problem is exacerbated when the flight path within the mass analyzer comprises multiple changes of direction.

In some forms of TOF mass analyzers, such as multi-turn analyzers, a single turn of the analyzer, followed by ejection to a detector outside the analyzer may be utilized to monitor the beam. A similar approach may be taken in other forms of mass analyzer where the beam path is folded back upon itself, i.e. ejection to an external detector for monitoring after the beam has traversed only a portion of the total beam path that would be used for a full mass analysis. In both cases an external detector is used for the full mass analysis at the end of the full flight path and the ion beam may be diverted from the main flight path to impinge upon it after any integer number of passes. However, for other types of analyzers the geometry of the analyzer and the resultant beam path may not conveniently allow ejection to the final detector until the entire flight path has been travelled. Monitoring the beam before it has followed the complete flight path is advantageous, as it allows the beam position and/or trajectory to be determined before multiple passes or multiple changes of direction have multiplied any beam misalignment, potentially causing the beam to be lost. It also allows a measurement of the quantity of ions within the beam in a much shorter time than would be required for a complete mass analysis involving multiple passes. However, multi-turn analyzers and other forms of mass analyzer where the beam path is folded back upon itself have limited mass range as low mass ions travel through the analyzer and catch up with high mass ions after multiple passes. The complex resultant spectrum of overlapping ions may be difficult or impossible to deconvolute and so a mass range restriction is required to avoid ions overlapping. It is desirable therefore to use mass analyzers in which no repeat path is used, in which case as already mentioned, the beam path may not conveniently allow ejection to the final detector until the entire flight path has been travelled.

It is also known in mass spectrometry to utilize parts of the analyzer structure as temporary beam monitoring devices. For example, the outer sector electrode of an electrostatic sector device may be disconnected from the voltage supply used to generate the electrostatic field during use as a TOF, and instead be connected to an electrometer. Ions, instead of being directed around the sector, collide with the outer sector electrode due to the absence of the analyzer electric field, and the current arriving at the outer sector electrode is measured by the electrometer. A similar approach may be taken utilising a lens within a MR-TOF, for example. However, use of analyzer electrodes as intermediate detection surfaces in this way renders the analyzer inoperable as a mass analyzer as the voltage supply must be disconnected for measurement to be made, and then reconnected again, and the analyzer field is thereby disrupted. The process is slow, and the measurement is made in the absence of the correct analyzer field. Beam aperture plates may be used as intermediate detector surfaces for beam monitoring, again using an electrometer. In the presence of the normal analyzer field, such an aperture plate transmits ion beam and the charge impinging upon the aperture plate is only a measure of the beam losses. In order to measure the charge present in the whole beam the analyzer field must be changed in order to direct the whole beam onto the aperture plate such that substantially no beam passes through the aperture. Furthermore, in recent multi-sector and MR-TOF designs, fields may be present throughout the analyzer and no such aperture plates may be present as they may both be unnecessary and would distort the electric field in their vicinity.

To measure smaller beam currents, secondary electron multipliers may be used, as are described for example by A. E. Giannakopulos et. al. in Int. J. Mass Spectrom. and Ion Processes, 131, (1994), 67. However these forms of detection system are costly, they require structures to be formed within the analyzer to house the multiplier, the presence of which may compromise the quality of the electric field within the analyzer. Furthermore, the detection efficiency of electron multipliers is dependent upon the chemical composition of, and strongly dependent upon the velocity of, the ions to be detected.

In view of the above, the present invention has been made.

SUMMARY OF INVENTION

In one aspect, the present invention provides a method of determining properties of ions within a time of flight or electrostatic trap mass analyzer comprising the steps of:

(1) injecting ions into the mass analyzer;

(2) causing the ions to follow a portion of a main flight path within the mass analyzer, the main flight path comprising multiple changes of direction;

(3) applying a beam deflection to deflect at least some of the ions from the main flight path so that they impinge upon a detection surface located within the mass analyzer, the detection surface comprising part of an active field-sustaining electrode of the mass analyzer;

(4) measuring a quantity representative of the charge arriving at the detection surface caused by the impinging ions;

(5) determining, from the deflection applied, properties of a trajectory upon which the ions were travelling immediately prior to deflection, and/or determining, from the quantity measured, a value representative of the number of the ions that impinged upon the detector surface;

wherein the analyzer utilises an analyzer field, and the analyzer field in the vicinity of the detection surface is substantially non-zero.

In another aspect, the present invention provides a time of flight or electrostatic trap mass analyzer comprising a detection surface located within the mass analyzer, the detection surface being, in use, part of an active field-sustaining electrode of the mass analyzer; and a deflector, the deflector being for deflection of ions onto the detection surface, the analyzer having in use a flight path comprising multiple changes of direction and wherein the analyzer utilises an analyzer field, and the analyzer field in the vicinity of the detection surface is substantially non-zero.

In some preferred embodiments of the present invention the detection surface sustains the analyzer field in its vicinity.

Herein ions will be referred to as an example of charged particles without excluding other types of charged particles unless the context requires it. A packet of ions comprises a group of ions, the group usually comprising a variety of mass to charge ratios, which is, at least initially, spatially confined. Preferably ions are injected into the TOF or EST mass analyzer as a packet.

The main flight path herein means the flight path followed by the ions as they are being separated within the mass analyzer according to their mass to charge ratio, i.e. the main flight path is therefore a volume of space within the analyzer within which the ions travel as they pass through the analyzer whilst the analyzer is operating to separate the ions according to their mass to charge ratio. The main flight path comprises multiple changes of direction, the changes of direction may be caused by utilising multiple electrostatic sectors, multiple ion mirrors, multiple ion deflectors, or the like. Accordingly the mass analyzer comprises an EST or a TOF mass analyzer. Mass analyzers suitable for use with the present invention include, for example, multi-reflecting TOF, sector TOF, multi-sector TOF and Orbitrap™ EST. Preferred analyzers include a multi-reflecting TOF and more preferred analyzers include a multi-reflecting TOF formed from two closely-coupled linear field mirrors comprising inner and outer field-defining electrode systems elongated along an axis.

As used herein, the term multiple changes of direction is used to describe a plurality of alternating changes of direction in at least one coordinate of motion. Multiple changes of direction are executed by ions which undergo a plurality of reflections or orbits, such as in multiple reflector, multiple sector and helical path TOF analyzers, for example. Preferably said coordinate of motion is in a direction of time of flight separation.

In the method of the present invention ions are injected into the analyzer and proceed along a portion of the main flight path before being deflected so that they impinge upon the detection surface, both deflector and detection surface being located within the analyzer. Accordingly ions may travel along the main flight path and be deflected before they undergo any changes of direction, or in other cases the ions may be deflected after they have undergone one or more changes of direction.

The mass analyzer utilises an analyzer field within the analyzer whilst operated to separate ions according to their mass to charge ratio. Preferably the analyzer field comprises an electric field. More preferably the analyzer field is an electrostatic field. The analyzer field acts within the analyzer to force the ions to follow the main flight path and accordingly the main flight path is located within the analyzer field. The mass analyzer comprises one or more field-sustaining electrodes to sustain the analyzer field, at least one of which comprises the detection surface, i.e. the detection surface comprises part of one of the field-sustaining electrodes of the analyzer.

The analyzer field is distorted in a volume of space local to the beam deflector when the beam deflector is set to deflect the beam so that it impinges upon the detection surface. However elsewhere within the analyzer the analyzer field is more or less undistorted, depending upon, for example, the distance from the deflector and the location of field-sustaining electrodes. Shielding electrodes may be placed around the deflector to limit the volume of space in which the analyzer field is distorted, the shielding electrodes being appropriately electrically biased so as to sustain the analyzer field outside the volume of space they surround which contains the beam deflector. Accordingly the shielding electrodes are themselves field-sustaining electrodes.

The term active herein refers to a state wherein the field-sustaining electrodes are energized to sustain the analyzer field. Accordingly, in some embodiments of the present invention the detection surface comprises a field sustaining electrode which is in an active state, i.e. whilst it is sustaining the analyzer field. In this way the monitoring of the trajectory that the ions were travelling on immediately prior to deflection is enabled to be performed in the analyzer field. Additionally, both monitoring the trajectory and measuring the quantity of ions may be made rapidly between mass analyses, as the detection surface which is connected to a sensitive charge amplifier is not switched in voltage, as, when both mass analysis is occurring and when beam monitoring is occurring, the detection surface has substantially the same potential applied to it. Accordingly, beam monitoring may be performed between mass analysis runs with minimal loss of time, improving the duty cycle. Preferably the detection surface comprises an active field-sustaining electrode. In other embodiments the detection surface may be temporarily electrically biased so as to deflect ions such that they impinge upon it. In these embodiments the detection surface does not at that time comprise an active field-sustaining electrode but instead comprises a deflector; nevertheless the detection surface at all times and in all embodiments comprises part of another active field-sustaining electrode, i.e. the detection surface is located within or upon an active field-sustaining electrode. In these embodiments the detection surface may comprise the only deflector necessary to cause the ions to be deflected from the main flight path and impinge upon the detector surface, or there may be additional deflectors within the analyzer. In all embodiments of the present invention the analyzer field in the vicinity of the detection surface is substantially non-zero.

The beam deflector may be any type of switchable ion optical device capable of changing the direction of the trajectory of the ions which may be, for example, in the form of an ion beam or packet of ions. Deflection may be achieved by the use of electric and/or magnetic fields. Examples include parallel plate deflectors, electric sectors, magnetic sectors, coils, and electric or magnetic lenses. Preferably the deflector utilises electric fields; preferably the deflector comprises an opposing pair of substantially parallel, flat plates, one plate either side of the main flight path. The deflector, in use, may be energized to deflect the beam from the main flight path or de-energized to deflect the beam from the main flight path but is preferably energized to deflect the beam from the main flight path. The beam deflector is preferably located within the analyzer adjacent to at least a point upon the main flight path. The beam deflector may be located adjacent to any suitable point upon the main flight path. As noted above, the detection surface may comprise a deflector.

The detection surface is located within or upon a surface of one of the field sustaining electrodes. The detection surface may be flat or curved. The detection surface may or may not have planes of symmetry; it may be a regular or an irregular shape. The detection surface is located within the mass analyzer, by which is hereby meant that the detection surface is within or upon a structure or group of structures which, in use, define the mass analyzer field and the detection surface therefore is located within the space occupied by at least a portion of the analyzer field. The detection surface may be adjacent to the main flight path or may be at a substantial distance from the main flight path. The detection surface is connected to a device for measuring a quantity representative of the charge arriving at the detection surface. Preferably the device for measuring a quantity representative of the charge arriving at the detection surface is a charge sensitive amplifier. More preferably this charge sensitive amplifier is an electrometer. In embodiments where the detection surface comprises an active field-sustaining electrode of the mass analyzer, the detection surface is appropriately shaped and, whether or not ions are deflected to impinge upon it, is electrically biased so that the mass analyzer field is substantially sustained thereby, in a volume of space local to the detection surface. Therefore in these embodiments as well as being connected to a device for measuring a quantity representative of the charge arriving at the detection surface, the detection surface is also connected to any power supply necessary to electrically bias it so that the mass analyzer field is substantially sustained thereby, local to the detection surface. Connection to any power supply herein includes connection to such a power supply via another electrode. In such embodiments, any device for measuring a quantity representative of the charge arriving at the detection surface which is connected to the detection surface, such as an electrometer for example, is floated to the potential supplied by the power supply. Preferably when both mass analysis is occurring and when beam monitoring is occurring, the power supply connected to the detection surface is controlled to generate the same potential to high precision. The detection surface is a surface provided specifically for the detection of ions and, at the same time, is, in some embodiments, an active field-sustaining electrode of the mass analyzer. In other embodiments the detection surface is a surface provided specifically for the detection of ions and, at the same time, is a deflector. The detection surface is therefore a surface which performs two functions at the same time: detection and sustenance of the mass analyzer field in a volume of space local to the detection surface in some embodiments, and detection and beam deflection in other embodiments. The analyzer field in the vicinity of the detection surface is a substantially non-zero electric field. The analyzer utilises an analyzer field, and in all embodiments of the present invention the analyzer field in the vicinity of the detection surface is substantially non-zero. In some embodiments the detection surface sustains the analyzer field in its vicinity. The detection surface may form part of any type of field-sustaining electrode, for example it may from part of a lens, a mirror, an electric sector, elongated rods or a set of any of such elements.

In some embodiments the detection surface may be located in the vicinity of the deflector, or it may be located a substantial distance from the deflector. Even where the detection surface is located in the vicinity of the deflector, the ion beam may follow a flight path which traverses a considerable distance between passing the deflector and arriving at the detection surface as the flight path may, for example, execute an orbit, a reflection, a folded path or combinations thereof between the deflector and the detection surface. This may be the case in embodiments where the detection surface comprises an active field-sustaining electrode or in embodiments where the detection surface comprises a deflector. In other embodiments where the detection surface comprises a deflector, ions may be directly attracted to the detection surface by the application of an attractive potential to the deflector. An additional advantage may be gained in embodiments in which the detection surface does not comprise the deflector, by locating the deflector either at a sufficient distance from the detection surface and/or in a location electrically shielded from the detection surface. In these cases the operation of switching the deflector on or off does not then significantly disturb any electrometer connected to the detection surface by the inducement of electrical pickup.

In use, the deflector is energized or de-energized to provide a beam deflection to deflect at least some of the ions from the main flight path upon which they were travelling so that they impinge upon the detection surface. Impinging ions contribute to the charge arriving at the detection surface. The ions that impinge upon the detection surface may be only a subset of the total number of ions within the analyzer. Preferably the ionic charge of ions impinging upon the detection surface substantially comprises all the charge arriving at the detection surface. However it may be that other sources of charge may also be arriving at the detection surface, such as, for example, secondary electrons generated by ions striking other surfaces nearby.

The method of the present invention provides a means for determining, from the deflection applied, properties of the trajectory upon which the impinging ions were travelling immediately prior to deflection, and/or determining, from the quantity measured, a value representative of the number of the at least some of the ions within the mass analyzer. The magnitude of the deflection applied to the ions to cause the ions to impinge upon the detection surface enables properties of the trajectory upon which the detected ions were travelling immediately prior to deflection to be inferred. Preferably the properties include, for example, the ion energy, the trajectory location and the ion trajectory direction. Such properties may be inferred as it is known that a more energetic ion beam requires a larger deflecting force to deflect the ions by a given angle than does a less energetic beam. For example if the deflector utilizes an electric field provided by the application of a pair of opposing potentials to a pair of parallel plates, a larger potential difference applied to the plates provides a larger deflection force. Knowledge of the geometry of the deflector structure, the analyzer field, the locations of the deflector and the detection surface, together with the potential difference applied, enables the skilled person to calculate some characteristic properties of the detected ion beam. In addition or alternatively, from the magnitude of the detected signal, a value representative of the number of the ions within the mass analyzer may be deduced. The magnitude of the detected signal provides information about the number of charges in the deflected ion beam which impinged upon the detector surface. The number of charges may be used to calculate or estimate the number of ions in the deflected ion beam which impinged upon the detector surface and this may be used to calculate the number of ions present within the mass analyzer. The number of ions within the mass analyzer may not be the same as the number of ions in the deflected ion beam which impinged upon the detector surface as the deflector may be operated so as to deflect only a portion of the ions within the analyzer, leaving all other ions to continue along the main flight path. This may be accomplished by energizing, or de-energizing the deflector for a limited period of time, causing only some ions to be deflected. The term properties of ions used herein includes the quantity of ions or the quantity of a subset of ions.

There may be a plurality of detection surfaces within the analyzer, having ions directed to them from a single deflector, or preferably multiple deflectors. A given deflector may direct ions from the main flight path to one or more detection surfaces if, for example, a different voltage is applied to the deflector, producing a different deflection force. Alternatively or additionally, a deflector may direct ions from the main flight path to one or more detection surfaces if it operates with the same deflection force but ions approach it upon the main flight path from different directions. Ions may follow the main flight path in one direction through the mass analyzer and be directed to retrace all or part of their trajectory back through the analyzer to increase the total flight path length, and they may then, for example, pass adjacent to a deflector as they travel in both directions. Alternatively or additionally, the main flight path may cross over itself in one or more places within the analyzer without ions following the same path and a deflector may be arranged to lie adjacent one or more such beam cross-overs.

Different detection surfaces may be utilized within the same mass analyzer. The detection surfaces may be different shapes, sizes and orientations. Some detection surfaces may utilise additional electron multiplication whilst others may not and accordingly some detection surfaces may be used for one purpose and others for a different purpose.

The passage of ions along the main flight path and the transfer of ions between ion optical devices such as the deflector and the detection surface, for example, may not be without ion loss. Accordingly, the invention is not limited to the case where all ions are transferred along a path or between devices in each or any step of the method.

DETAILED DESCRIPTION

Various embodiments of the present invention will now be described by way of the following examples and the accompanying Figures.

Figure 1B:
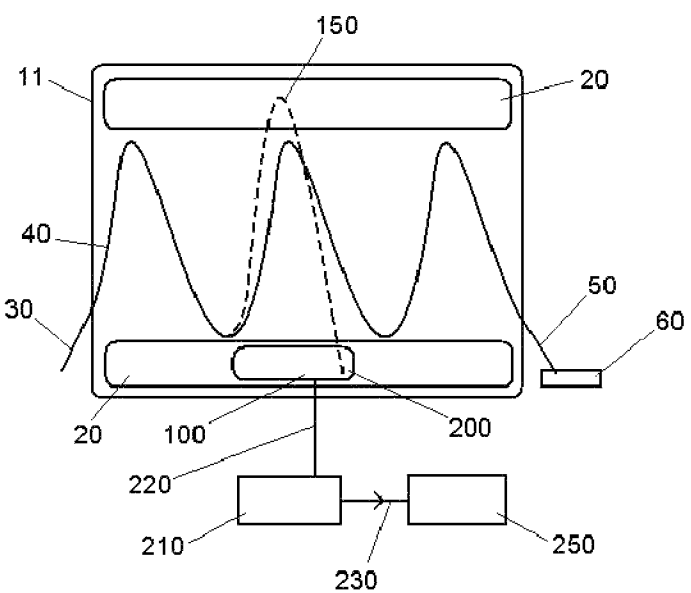
FIG. 1 is a schematic diagram illustrating aspects of the present invention.
Figure 1A:
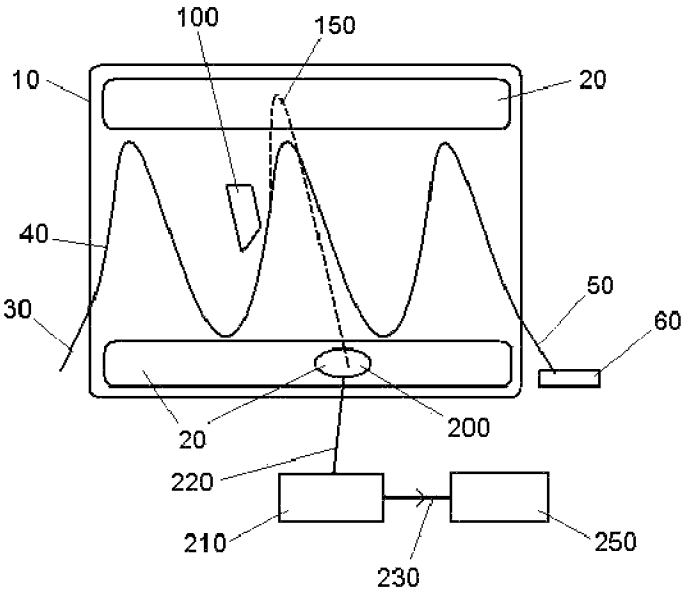

Referring to the schematic diagram of FIG. 1*a*, a TOF or EST mass analyzer 10 comprises active field-sustaining electrodes 20. Ions are injected into the analyzer along entry trajectory 30, and when the mass analyzer 10 is operated to separate ions according to their mass to charge ratio, the ions follow a main flight path 40 within the analyzer, leaving the analyzer along exit trajectory 50 to be detected by detector 60 outside the analyzer. The analyzer utilises an analyzer field whilst operated to separate ions according to their mass to charge ratio. Deflector 100 and detection surface 200 are located within the analyzer. Detection surface 200 also comprises part of an active field-sustaining electrode 20 and is maintained at an electrical potential which sustains the analyzer field in its vicinity. The detection surface 200 is physically incorporated into field-sustaining electrode 20, and is maintained at the same electrical potential as field-sustaining electrode 20 but is electrically insulated from it in such a way as to allow the detection surface to transmit charge impinging upon it to a detection system. In the method of the present invention, ions are deflected off the main flight path 40 by the action of deflector 100 to follow auxiliary path 150 to detection surface 200. Electrometer 210 is electrically connected via connection 220 to detection surface 200. Electrometer 210 measures a quantity representative of the charge arriving at the detection surface 200, and passes output 230 to controller 250 which comprises a computer. Electrometer 210 is a differential charge amplifier which rejects noise pickup from radio frequency drive potentials applied to other components within the mass spectrometer. This embodiment has the advantage that electrometer 210 may conveniently be connected across detection surface 200 and the adjacent field-sustaining electrode 20 in which detection surface 200 is located, as both these electrodes are held at the same potential. An example of such an embodiment will be further described below in relation to FIG. 2*e*.

An alternative embodiment is shown in FIG. 1*b*, where like features have the same identifiers as in FIG. 1*a*. TOF or EST mass analyzer 11 comprises active field-sustaining electrodes 20. Ions are injected into the analyzer along entry trajectory 30, and when the mass analyzer 11 is operated to separate ions according to their mass to charge ratio, the ions follow a main flight path 40 within the analyzer, leaving the analyzer along exit trajectory 50 to be detected by detector 60 outside the analyzer. The analyzer utilises an analyzer field whilst operated to separate ions according to their mass to charge ratio. Deflector 100 and detection surface 200 are located within the analyzer and comprise the same electrode. The detection surface 200 is physically incorporated into field-sustaining electrode 20, but is electrically insulated from it during the detection process and does not itself form an active field-sustaining electrode at that time. In the method of the present invention, ions are deflected off the main flight path 40 by the action of deflector 100 to follow auxiliary path 150 to detection surface 200. In this example the deflector 100 disturbs the analyzer field, repelling ions from the deflector, whereupon they follow auxiliary path 150 and after a change of direction impinge upon detection surface 200, despite the repulsive electrical potential applied to the detection surface 200. In other embodiments, an attractive potential may serve the same purpose. Electrometer 210 is electrically connected via connection 220 to detection surface 200. Electrometer 210 measures a quantity representative of the charge arriving at the detection surface 200, and passes output 230 to controller 250 which comprises a computer. Electrometer 210 is a differential charge amplifier which rejects noise pickup from radio frequency drive potentials applied to other components within the mass spectrometer.

In the embodiments of both FIG. 1*a* and FIG. 1*b*, controller 250 is used to control preceding ion optical devices (not shown) which influence the entry trajectory 30, and/or the analyzer field. The entry trajectory 30 for the next packet of injected ions may thereby be adjusted, and/or the analyzer field may thereby be adjusted by, for example, altering the electrical potentials applied to field-sustaining electrodes 20, so as to control the ion beam path through the analyzer 10. It is desirable to control the ion beam path through analyzer 10,11 so as to direct the ion beam along the optimum path which may provide, for example, the highest transmission, and/or the highest mass resolution. The present invention may thereby be used in a feedback system to enable the ion beam to be aligned and the mass analyzer to be tuned, using controller 250, on the basis of the quantity representative of the charge arriving at the detection surface and/or the properties of the trajectory upon which the ions were travelling immediately prior to deflection. It is advantageous to detect the ion beam after it has traversed only a portion of the main flight path so that beam misalignments that would cause the ion beam to be lost at a downstream location along the main flight path may be detected and subsequently injected ion beams may be realigned.

Controller 250 is also used to control preceding ion optical devices (not shown) so that a desired number of ions is passed to analyzer 10,11 in the next injected packet, on the basis of the quantity of charge that was detected by electrometer 210. The quantity of charge detected by electrometer 210 is indicative of the number of ions that reached detection surface 200, and this in turn is indicative of the number of ions that were injected into analyzer 10,11. Where it is desirable to inject a certain quantity of ions into analyzer 10,11, so as, for example, to optimally fill analyzer 10,11 so that mass resolution is not adversely affected by space charge, or to ensure detector 60 is not overloaded, the quantity of ions can be controlled as just described by controller 250, which is a form of automatic gain control (AGC). Alternatively or additionally the gain of detector 60 may also be adjusted by controller 250 on the basis of the quantity of charge that was detected by electrometer 210, providing the advantage that the detection system is thereby prepared for the quantity of ions that will subsequently arrive at detector 60. The useful dynamic range of the detection system may thereby be arranged to accommodate the arrival rate of ions that are either already in flight within the analyzer or which will be injected into the analyzer in a subsequent injection.

The detection surface 200 may be connected to various types of charge amplifiers. Additional electron multiplication means such as venetian blind or channeltron multipliers may be used where they can be positioned to receive secondary electrons released from the detection surface in response to impinging ions. Advantages of these types of multipliers include that they may be operated at fast repetition rates due to their high bandwidth and that they may measure very small ion currents. Alternatively electrometers without further electron multiplication may be used, in which case the net charge received by the detection surface is measured, which includes the ionic charge received from impinging ions and possibly the charge due to secondary electrons and/or secondary ions being released from the surface of the detector. Advantages of this type of detection include that the detection efficiency is not dependent upon a process in which the kinetic energy of the impinging ions is converted into secondary electrons, which, as already described, is dependent upon the mass of the impinging ions and their chemical composition.

In embodiments where the deflector is placed adjacent the main flight path relatively closer to the entrance of the mass analyzer than its exit, the process of obtaining a measurement representative of the number of ions in the beam for the purpose of AGC or for the purpose of adjusting the gain of a final time-of-flight detector is far shorter than the analysis time where a packet of ions is injected, separated and then detected outside the mass analyzer. For AGC purposes, for example, the number of ions that may be utilised may be far higher than the number usefully utilised in an analysis, as space charge effects upon mass resolution, for example, are not important to the process of AGC and may be tolerated. This enables relatively low bandwidth charge detection systems to be used, reducing cost. AGC in MR-TOF is preferably used when acquiring large mass range spectra, and where the mass analyzer is part of a spectrometer system incorporating MS/MS and $MS^n$, where frequent checks on the instrument tuning are desired. Typically AGC measurements may be made before some or all full mass spectra are acquired and before some or all fragmentation spectra are acquired.

Figure 2A:
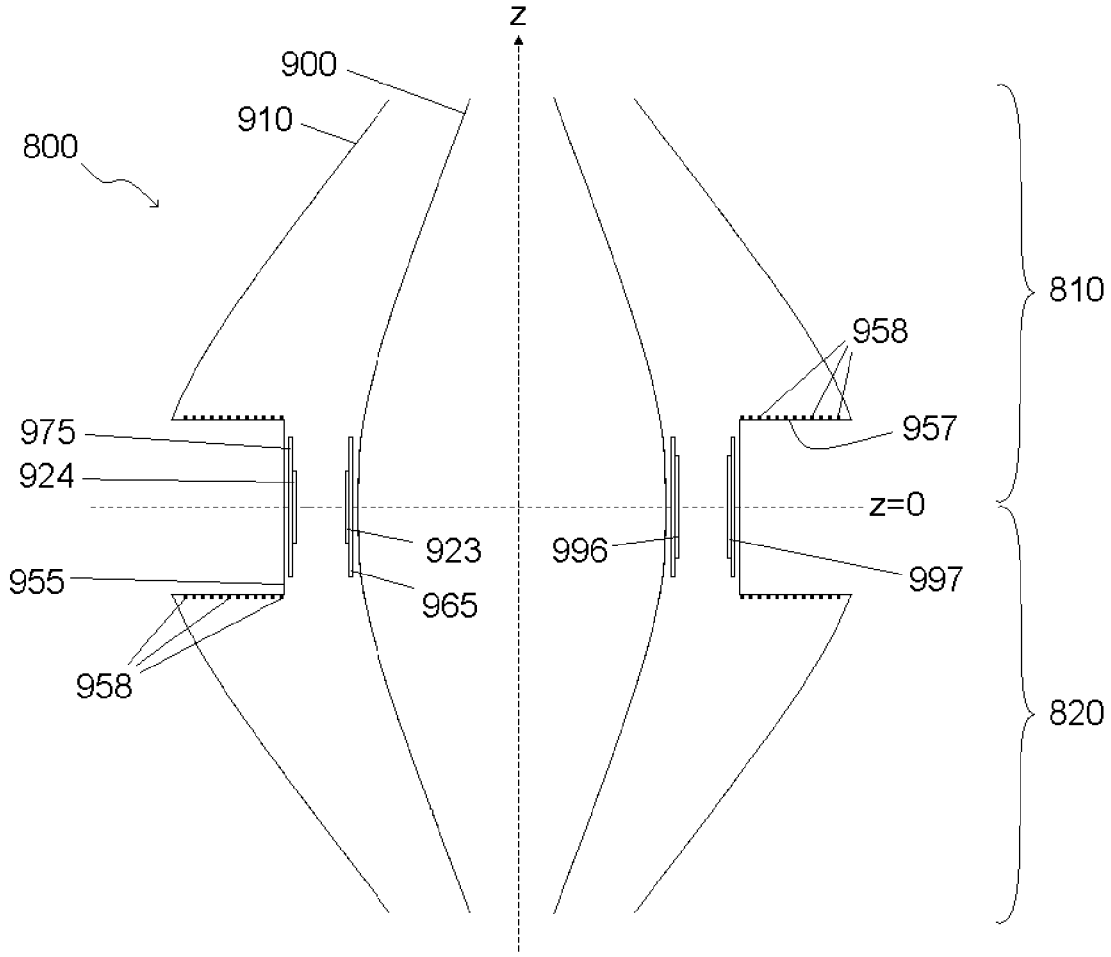
FIG. 2 shows schematic views of various embodiments of the present invention.

Referring to the schematic diagram of FIG. 2*a*, preferred analyzers include a multi-reflecting TOF 800 formed from two closely-coupled linear field mirrors 810, 820, opposing one another, comprising inner and outer field-defining electrode systems 900, 910 respectively, elongated along an axis z. Such an analyzer is described in detail in GB patent application 0909232.1 which is incorporated in its entirety herein by reference. FIG. 2*a* shows a cross section through the analyzer 800. The two mirrors 810, 820 are substantially symmetrical about the z=0 plane. Preferably the inner and outer field-defining electrode systems 900, 910 are concentric as shown in FIG. 2*a*. The inner and outer field-defining electrode systems 900, 910 of both mirrors 810, 820 are substantially rotationally symmetric about the analyzer axis. The outer field-defining electrode system 910 of each mirror is of greater size than the inner field-defining electrode system 900 and is located around the inner field-defining electrode system 900. As in the Orbitrap™ electrostatic trap, the inner field-defining electrode system 900 is of spindle-like form, with an increasing diameter towards the mid-point between the mirrors (i.e. towards the equator (or z=0 plane) of the analyzer), and the outer field-defining electrode system 910 is of barrel-like form, with an increasing diameter towards the mid-point between the mirrors. The field-defining electrode systems 900, 910 are of shapes that produce a quadro-logarithmic potential distribution within the mirrors. The outer field-defining electrode systems of both mirrors 910 have a waisted-in portion, 955, in a region crossing the z=0 plane. Where the outer field-defining electrode systems 910 of both mirrors waists in at 957, an array of electrode tracks 958 is positioned at different radial positions facing into the analyzer. These electrode tracks are suitably electrically biased so that they inhibit the waisted portion of the outer field-defining electrode system from distorting the quadro-logarithmic potential distribution elsewhere within the analyzer. The array of electrode tracks 958 may be exchanged for a suitable resistive coating as an alternative, for example, or other electrode means may be envisaged. As termed herein, due to their function, the array of electrode tracks, resistive coating or other electrode means for inhibiting distortion of the main field form part of the outer field-defining electrode system of the mirror to which they relate. Field-defining belt electrodes 965, 975 are located in the region of the z=0 plane, surrounding inner field-defining electrode system 900. The inner and outer belt electrode assemblies 965 and 975 respectively support inner and outer deflection electrodes 923, 924 respectively. Opposing lens elements 996, 997 are also supported upon the inner and outer belt electrode assemblies 965 and 975 respectively. Additional pairs of lens elements similar to lens elements 996, 997 are supported upon the inner and outer belt electrode assemblies 965, 975 spaced annularly all around the z axis except in the region where inner and outer deflection electrodes 923, 924 are located. These lens elements serve the function of controlling ion beam divergence as the ion beam follows the main flight path between the pairs of lens elements as described in more detail below. Both the deflection electrodes 923, 924 of the deflector assembly and the lens electrodes 996, 997 are shown schematically to be proud of the belt electrode assemblies 965, 975 in which they are mounted, for clarity in the figure, but in practice, these electrodes may be set into the belt electrode assemblies and the surfaces of the belt electrode assemblies and the deflector and lens electrodes may be flush. The inner surface of the waisted-in portion 955 of the outer field-defining electrode system is used to support the outer belt electrode, 975 which in turn supports deflector and lens electrodes 924, 997 respectively. Inner and outer belt electrode assemblies 965 and 975 respectively may then conveniently be mounted within the analyzer from the inner and outer field-defining electrode systems 900, 910 respectively. The belt electrode assemblies 965 and 975 may be mounted from the inner and outer field-defining electrode systems 900, 910 via short insulators or an insulating sheet, for example.

Figure 2B:
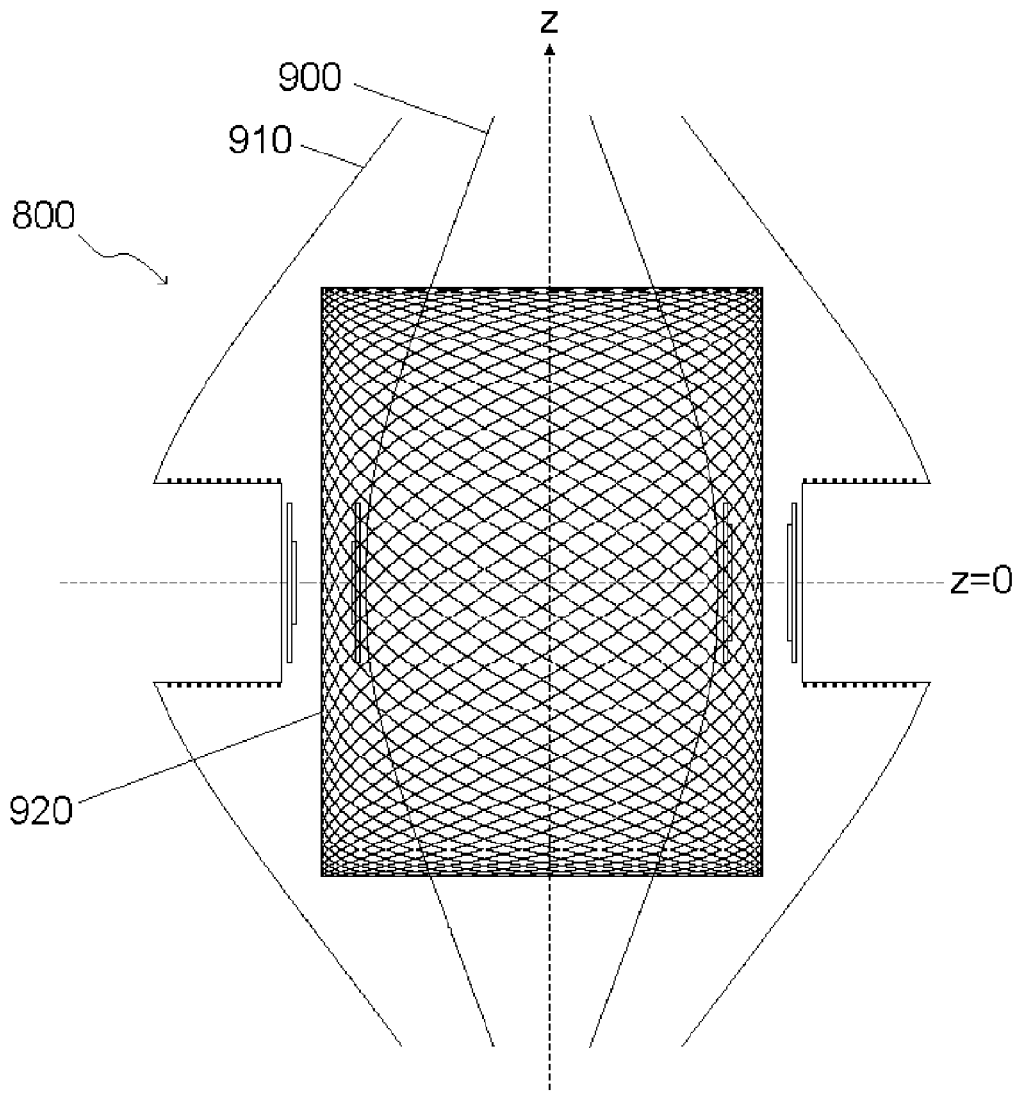

FIG. 2*b* is a schematic diagram of the same analyzer 800 as is depicted in FIG. 2*a*, with reference numbers removed so that a main flight path may be seen with clarity. The main flight path is orbital and describes a repeating helix 920 located between the inner and outer field-defining electrode systems 900, 910. The orbital motion of the beam is a helical motion orbiting around the analyzer axis z whilst travelling from one mirror to the other in a direction parallel to the z axis. The helical main flight path 920 proceeds around the axis z multiple times before repeating the same path. Ions may be ejected for detection before the path does thus repeat, providing a TOF mass analyzer with no mass range restriction. The main flight path 920 passes the equator of the inner field-defining electrode structure (the plane z=0) multiple times, each time being offset by an angle around the z axis from the previous pass. The main flight path 920 passes between opposing lens elements (996, 997 and other pairs not shown) which are mounted upon the belt electrode assemblies as described above and the beam divergence may be controlled by the lens elements multiple times as the beam passes through the analyzer. The ion beam travelling along the main flight path 920 will thus also pass appropriately sized deflection electrodes 923, 924 (as referenced in FIG. 2*a*) at least once, and such electrodes may be used to deflect the ion beam from the main flight path so that it subsequently impinges upon a detection surface (not shown), as in the method of the present invention.

Figure 2C:
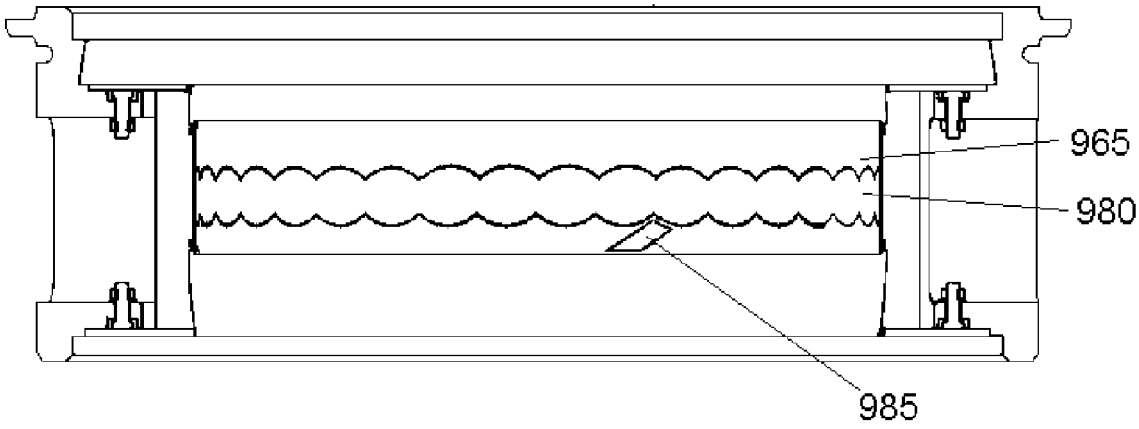

FIG. 2*c* shows a side view of a portion of an analyzer of the type described in relation to FIG. 2*a* and FIG. 2*b*, showing some alternative embodiments and a preferred location for the detection surface. The outer field-defining electrode 910 is not shown in the figure for clarity. Inner belt electrode 965 supports continuous lens element electrode 980 which in use controls the angular divergence of the beam in a similar way to lens element 996 of FIG. 2*a*. A similar continuous lens element is located upon the outer belt electrode assembly, but is not shown. In use to control angular divergence, the lens elements upon inner and outer belt electrode assemblies have an electrical potential of the same polarity and a similar magnitude applied. The example depicted in FIG. 2*c* shows an alternative arrangement for locating the deflection electrode which avoids the omission of a lens element as, in this example, continuous lens electrode 980 is used as the deflector, to deflect all or a portion of the ion beam as it passes the z=0 plane in a first pass, by having opposing polarity potentials applied to inner and outer lens electrodes. Any ion beam passing the equator of the analyzer then is deflected off the main flight path. Ions at a certain point around the equator that thus leave the main flight path impinge upon detection surface 985 in a subsequent pass. The flight path of the deflected ions thus executes an orbit and two reflections between deflection by the deflector and being received by the detection surface. In this way a portion or all of the injected ion beam may be sampled. Detection surface 985 is located adjacent the continuous lens electrode 980 and is biased at the same potential as the inner belt electrode assembly 965, thereby sustaining the analyzer field in its vicinity. In this example, continuous lens element 980 and detection surface 985 are set into belt electrode 965.

Figure 2D:
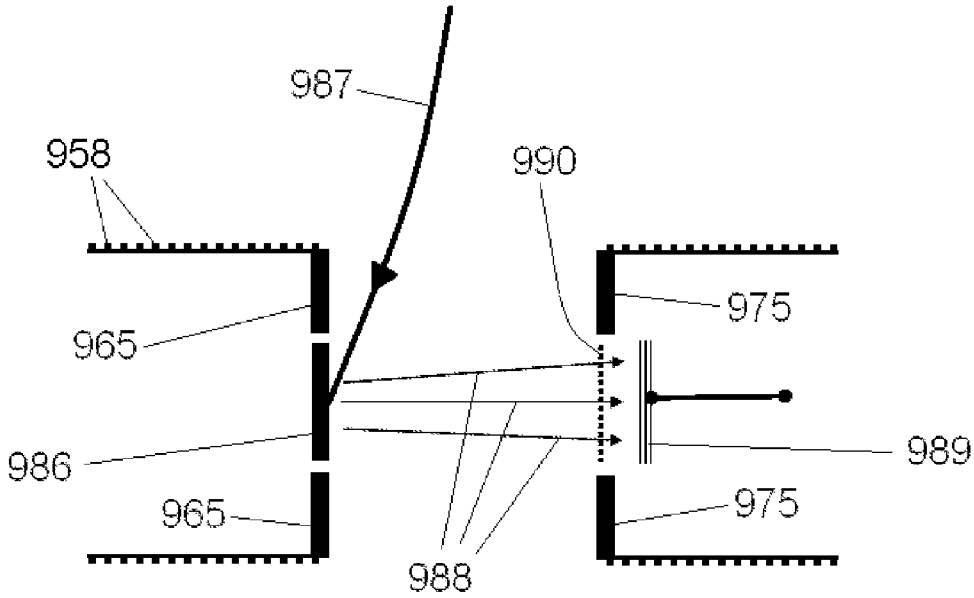

FIG. 2*d* shows a schematic cross sectional side view of a portion of an analyzer of the type described in relation to FIG. 2*a* and FIG. 2*b*, showing some alternative embodiments. In this example, the detection surface is utilised in conjunction with an electron multiplying system. FIG. 2*d* shows a schematic view of part of both inner and outer belt electrodes 965, 975 respectively. Detection surface 986 is an active field-sustaining electrode set within inner belt electrode 965. Positively charged ions 987 impinging upon detection surface 986 generate secondary electrons 988 which, under the action of the analyzer field, are repelled from detection surface 986 and impinge upon anode 989 after passing through slit plate 990. Slit plate 990 is part of outer belt electrode 975 and serves to sustain the analyzer field in the volume of space local to slit plate 990 whilst allowing secondary electrons 988 to pass to anode 989 which is part of an electron multiplying apparatus. In this arrangement ions are deflected by a deflection electrode elsewhere within the analyzer (and not shown in the figure). In an alternative embodiment, detection surface 986 itself acts as a deflector and is not an active field-sustaining electrode, in which case ions may be deflected as they pass close to detection surface 986 in a first orbit, causing the ions to impinge upon detection surface 986 in a subsequent orbit, or they may be deflected onto detection surface 986 by a sufficiently strong attractive potential which is applied as ions approach detection surface 986 so that the ions are deflected and detected whilst travelling the same orbit.

Figure 2E:
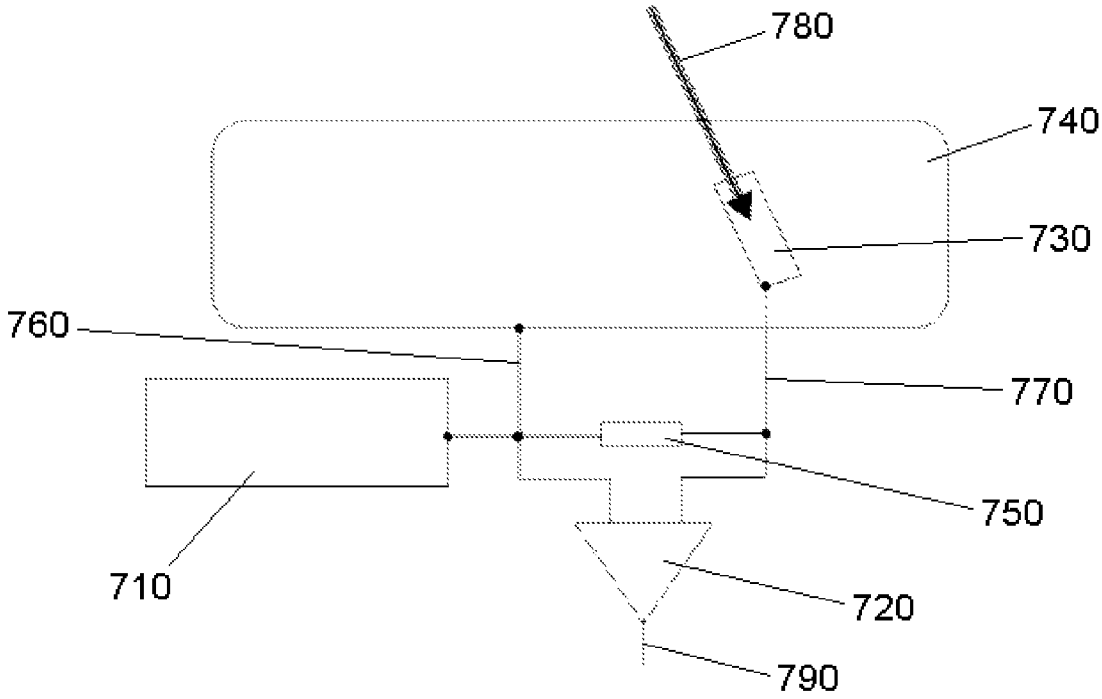

FIG. 2*e* shows a schematic diagram illustrating how a high voltage power supply 710 and electrometer 720 may be connected to a detection surface 730 and adjacent field-sustaining electrode 740. Resistor 750 is connected between connections 760 and 770. Connection 760 electrically connects high voltage power supply 710 and one input of differential electrometer amplifier 720 to field-sustaining electrode 740. Connection 770 electrically connects a second input of differential electrometer amplifier 720 to detection surface 730. Ions 780 impinge upon detection surface 730. Electrometer 720 outputs a signal at output 790, the signal being representative of the charge impinging upon detection surface 730. In this arrangement resistor 750 has a value of 10 MOhms. Suitable values for such resistors include, but are not limited to, the range 1 to 100 MOhms. The rapid change in charge arriving at detection surface 730 is registered by differential electrometer amplifier 720 via connection 770 whilst noise pickup from detection surface 730 and field-sustaining electrode 740 largely cancel as similar noise appears on both inputs 760, 770 of differential electrometer amplifier 720.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

The invention claimed is:

1. A method of determining properties of ions within a mass analyzer comprising the steps of:

(1) injecting ions into the mass analyzer;

(2) causing the ions to follow a portion of a main flight path within the mass analyzer, the main flight path comprising multiple changes of direction;

(3) applying a beam deflection to deflect at least some of the ions from the main flight path so that they impinge upon a detection surface located within the mass analyzer, the detection surface comprising part of an active field-sustaining electrode of the mass analyzer;

(4) measuring a quantity representative of the charge arriving at the detection surface caused by the impinging ions;

(5) determining, from the deflection applied, properties of a trajectory upon which the ions were travelling immediately prior to deflection, and/or determining, from the quantity measured, a value representative of the number of the ions that impinged upon the detector surface;

wherein the mass analyzer utilises an analyzer field and the analyzer field in the vicinity of the detection surface is non-zero.

2. The method of claim 1 wherein the detection surface sustains the analyzer field in its vicinity.

3. The method of claim 1 wherein the active field-sustaining electrode has a potential applied to it and substantially the same potential is applied to the detection surface.

4. The method of claim 1 wherein the total number of ions within the mass analyzer is estimated from the value representative of the number of the ions that impinged upon the detector surface.

5. The method of claim 1 wherein the quantity representative of the charge arriving at the detection surface is measured using an electrometer.

6. The method of claim 5 wherein the beam deflection is effected by switching on a deflector and the deflector is located so that the act of switching on the deflector does not significantly disturb the electrometer due to electrical pickup.

7. The method of claim 1 wherein the quantity representative of the charge arriving at the detection surface is measured utilising electron multiplication.

8. The method of claim 1 wherein the detection surface forms part of any of: a lens, a mirror, an electric sector, elongated rods or a set of any of such elements.

9. The method of claim 1 wherein the quantity representative of the charge arriving at the detection surface is used to subsequently control the quantity of ions injected into the mass analyzer.

10. The method of claim 1 wherein the quantity representative of the charge arriving at the detection surface and/or the properties of the trajectory upon which the ions were travelling immediately prior to deflection are used for tuning the mass analyzer.

11. The method of claim 1 wherein the quantity representative of the charge arriving at the detection surface is used to adjust the gain of a detector.

12. The method of claim 1 wherein the mass analyzer is one of a time-of-flight mass analyzer and an electrostatic trap mass analyzer.

13. A mass analyzer comprising a detection surface located within the mass analyzer, the detection surface being, in use, part of an active field-sustaining electrode of the mass analyzer; and a deflector, the deflector being for deflection of ions onto the detection surface, the analyzer having in use a flight path comprising multiple changes of direction and wherein the analyzer utilises an analyzer field, and the analyzer field in the vicinity of the detection surface is non-zero.

14. The mass analyzer of claim 13 wherein the detection surface sustains the analyzer field in its vicinity.

15. The mass analyzer of claim 13 wherein the deflector comprises the detection surface.

16. The mass analyzer of claim 13 wherein the detection surface is connected to an electrometer.

17. The mass analyzer of claim 13 wherein the detection surface is utilised in an electron multiplying system.

18. The mass analyzer of claim 13 wherein the detection surface forms part of any of: a lens, a mirror, an electric sector, elongated rods or a set of any of such elements.

19. The mass analyzer of claim 13 wherein the quantity representative of the charge arriving at the detection surface is used to subsequently control the quantity of ions injected into the mass analyzer.

20. The mass analyzer of claim 13 wherein the quantity representative of the charge arriving at the detection surface is used to adjust the gain of a detector.

21. The mass analyzer of claim 13 wherein the quantity representative of the charge arriving at the detection surface and/or the properties of the trajectory upon which the ions were travelling immediately prior to deflection are used for tuning the mass analyzer.

22. The mass analyzer of claim 12 wherein the mass analyzer is one of a time-of-flight mass analyzer and an electrostatic trap mass analyzer.

* * * * *